US010820099B1

(12) United States Patent
Caspo et al.

(10) Patent No.: US 10,820,099 B1
(45) Date of Patent: Oct. 27, 2020

(54) DEVICE AND METHOD TO CONTROL A SPEAKER TO EMIT A SOUND TO PROTECT A MICROPHONE

(71) Applicant: MOTOROLA SOLUTIONS, INC., Chicago, IL (US)

(72) Inventors: Haim Caspo, Petach-Tikva (IL); Amihay Fink, Holon (IL); Avihu Cohen, Pardes Hana-Karkur (IL); Yaakov Moseri, Shoham (IL); Hadi Shvartz, Bat Hadar (IL); Evgeny Bialik, Reshon Letzion (IL)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 16/581,864

(22) Filed: Sep. 25, 2019

(51) Int. Cl.

| | |
|---|---|
| ***H04R 3/00*** | (2006.01) |
| ***H04R 19/04*** | (2006.01) |
| ***H04R 29/00*** | (2006.01) |
| ***H04R 1/04*** | (2006.01) |
| ***H04R 1/02*** | (2006.01) |

(52) U.S. Cl.
CPC ..... *H04R 3/007* (2013.01); *H04R 1/025* (2013.01); *H04R 1/04* (2013.01); *H04R 19/04* (2013.01); *H04R 29/004* (2013.01); *H04R 2201/003* (2013.01); *H04R 2499/11* (2013.01)

(58) Field of Classification Search
CPC ..... G10K 2210/1081; G10K 11/175; G10K 11/16; G10K 11/002; H04R 3/002
USPC ..... 381/71.9, 71.2, 71.6, 71.8, 94.8
See application file for complete search history.

(56) References Cited

U.S. PATENT DOCUMENTS

| | | | | |
|---|---|---|---|---|
| 9,204,222 | B2 | 12/2015 | Suvanto | |
| 2010/0188243 | A1* | 7/2010 | Tysowski | G01P 15/00 340/669 |
| 2012/0154157 | A1* | 6/2012 | George | G08B 21/02 340/584 |
| 2015/0379994 | A1* | 12/2015 | Goldstein | G06F 21/10 704/260 |
| 2016/0321903 | A1* | 11/2016 | Smits | G06F 19/3418 |
| 2019/0132662 | A1 | 5/2019 | Cheng et al. | |

FOREIGN PATENT DOCUMENTS

| | | | |
|---|---|---|---|
| JP | 2006352533 | A | 12/2006 |

* cited by examiner

*Primary Examiner* — Alexander Krzystan
(74) *Attorney, Agent, or Firm* — Perry + Currier, Inc.

(57) ABSTRACT

A device and method controlling a speaker to emit a sound to protect a microphone is provided. An example device: determines, using a motion detector, when a drop is occurring. The example device, in response to determining that a drop is occurring: controls a speaker of the example device to emit a sound according to one or more predetermined drop parameters, the sound to apply an acoustic pressure at a membrane of the MEMS microphone of the example device to reduce a deflection thereof that results due to one or more of the drop and an impact which ends the drop.

18 Claims, 5 Drawing Sheets

DEVICE AND METHOD TO CONTROL A SPEAKER TO EMIT A SOUND TO PROTECT A MICROPHONE

BACKGROUND OF THE INVENTION

Portable devices, such as cell phones, radios, and the like, generally include microphones and speakers. Increasingly, the microphones of portable devices are microelectrical-mechanical system (MEMS) microphones, which are prone to damage when the portable device is dropped and impacts a surface. For example, when the portable device impacts a surface, a membrane (e.g. a dynamic membrane) of the MEMS microphone may experience a sudden increase in pressure due to the mechanical impact (and/or sound produced as a result of the mechanical impact), which can damage the membrane.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
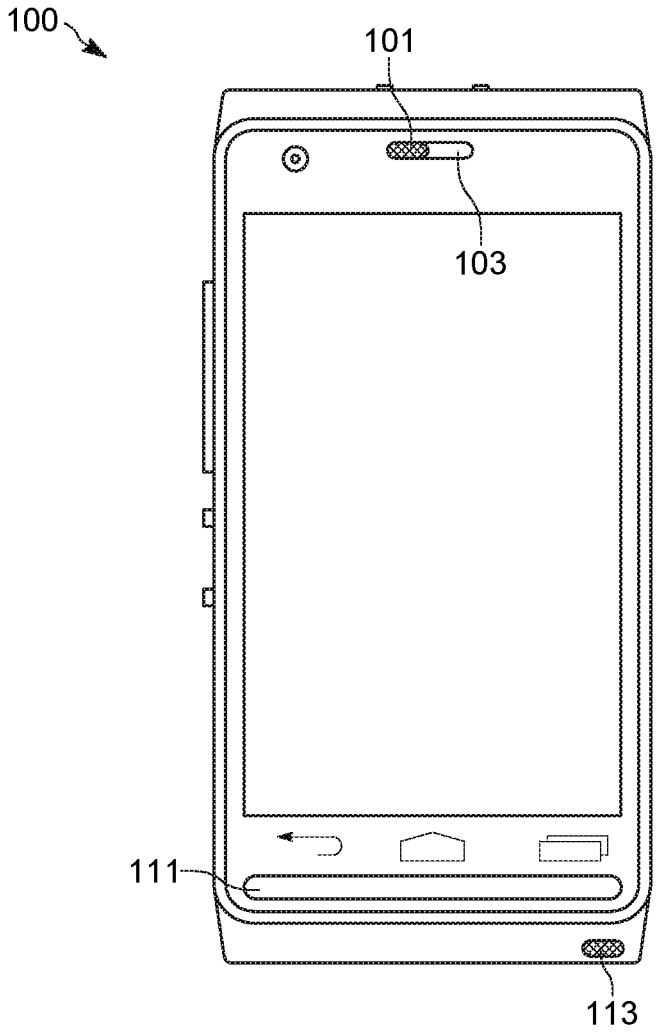
FIG. 1 is a device controlling a speaker to emit a sound to protect a microphone, in accordance with some examples.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Portable devices, such as cell phones, radios, and the like, generally include microphones and speakers. Increasingly, the microphones of portable devices are microelectrical-mechanical system (MEMS) microphones, which are prone to damage when the portable device is dropped and impacts a surface. For example, when the portable device impacts a surface, a membrane (e.g. a dynamic membrane) of the MEMS microphone may experience a sudden increase in pressure due to the mechanical impact (and/or sound produced as a result of the mechanical impact), which can damage the membrane. For example, drop tests have shown that pressures of up to 800 kPa to 900 kPa may occur at a membrane of a MEMS microphone of a portable device when the portable device impacts a surface as a result of a drop; put another way, such pressures may lead to membrane displacements of 1 mm or more.

Hence, provided herein is a device which includes a motion detector, a MEMS microphone and a speaker. The motion detector may detect a drop, and the speaker may be responsively controlled to emit a sound to apply an acoustic pressure to a membrane of the MEMS microphone. Such a sound causes the membrane to deflect, and/or such a sound causes tension to occur in the membrane, which reduces the deflection due to pressure that results when the portable devices impacts a surface.

An aspect of the specification provides a device comprising: a microelectrical-mechanical System (MEMS) microphone; a speaker; a motion detector; and a controller in communication with the motion detector and the speaker, the controller configured to: determine, using the motion detector, when a drop is occurring; and in response to determining that a drop is occurring, control the speaker to emit a sound according to one or more predetermined drop parameters, the sound to apply an acoustic pressure at a membrane of the MEMS microphone to reduce a deflection thereof that results due to the drop.

Another aspect of the specification provides a method comprising: determining, using a motion detector of a device, when a drop is occurring; and in response to determining that a drop is occurring, controlling a speaker of the device to emit a sound according to one or more predetermined drop parameters, the sound to apply an acoustic pressure at a membrane of a MEMS microphone of the device to reduce a deflection thereof that results due to the drop.

Attention is directed to FIG. 1 which depicts a device 100 for controlling a speaker to emit a sound to protect a microphone and in particular a microelectrical-mechanical System (MEMS) microphone. As seen in FIG. 1, the device 100 comprises a MEMS microphone 101 and a speaker 103. For example, the speaker 103 may be used to provide sound to a user of the device 100, for example during a call, and the MEMS microphone 101 may be used to determine background noise during the call in a feedback loop to reduce noise on the speaker 103.

As depicted, the MEMS microphone 101 and the speaker 103 are integrated into an earpiece of the device 100, for example at a "top end" of the device 100 (e.g. at a front face of the device 100), though the MEMS microphone 101 and the speaker 103 may be located at any suitable position at the device 100 and may be adjacent or separated from each other. Furthermore, the MEMS microphone 101 and the speaker 103 may be integrated into an earpiece, as depicted, or not integrated into an earpiece.

As depicted, the device 100 further comprises a second MEMS microphone 111 and a second speaker 113 located at a bottom end of the device 100, opposite the top end where the MEMS microphone 101 and the speaker 103 are located.

As will be described hereafter, the device 100 is generally configured to determine when a drop is occurring (e.g. when the device 100 is falling, and the like), and the device 100 may responsively control the speaker 103 (and/or the speaker 113) the emit a sound according to one or more predetermined drop parameters, the sound to apply an acoustic pressure at a membrane of the MEMS microphone 101 to reduce a deflection thereof that occurs due the device 100 impacting a surface as a result of the drop, as described hereafter.

Figure 2:
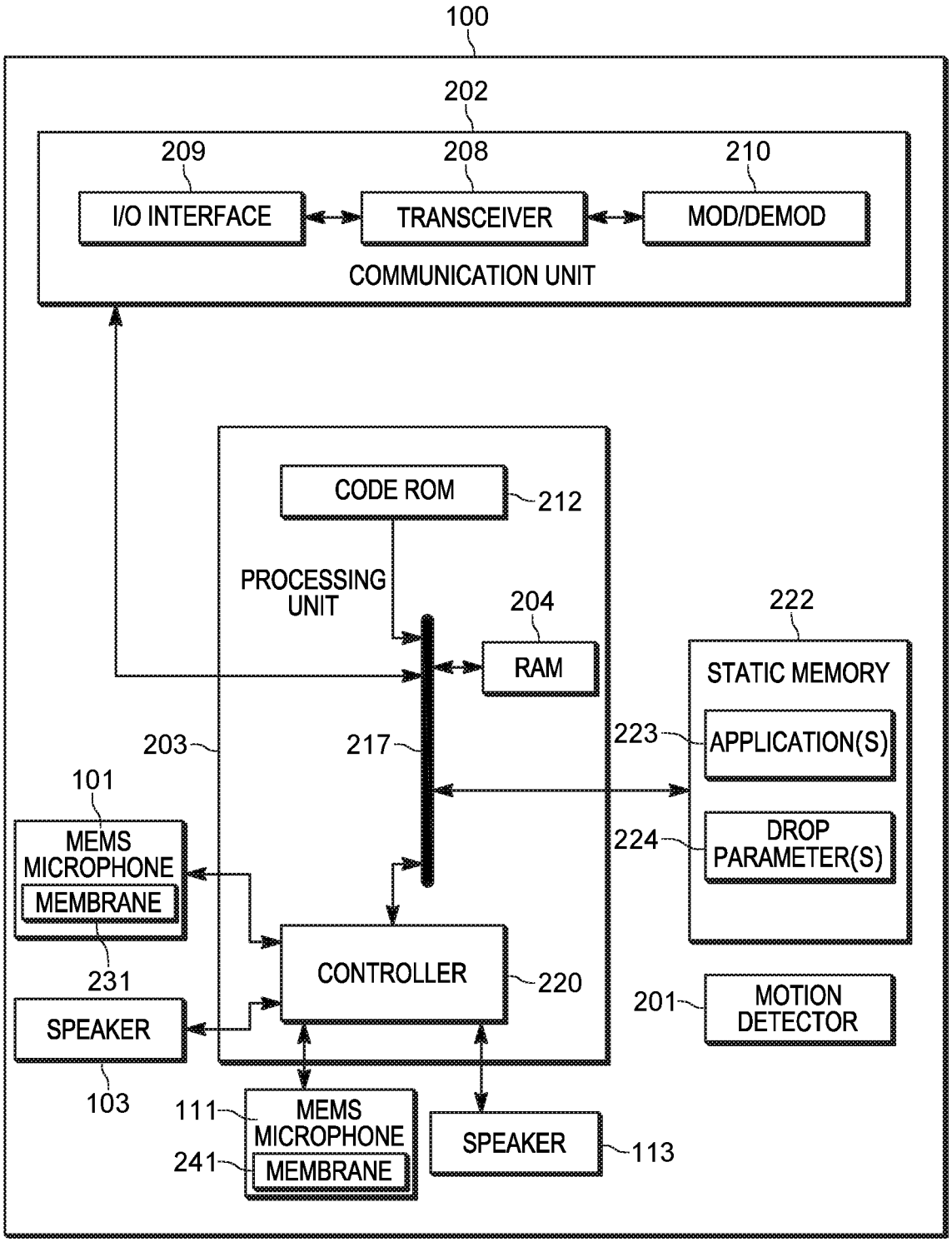
FIG. 2 is a device diagram showing a device structure of the device for controlling a speaker to emit a sound to protect a microphone, in accordance with some examples.

Attention is next directed to FIG. 2 which depicts a schematic block diagram of an example of the device 100. The device 100 may comprise any suitable portable device, partially portable device, and/or a device which may be dropped. In particular examples, the device 100 may comprise a cell phone (e.g. as depicted in FIG. 1), a radio, body-worn camera, a first responder device (e.g., such as a radio, a cell phone, body-worn camera, and the like), a laptop computer, a headset, and the like. In other words, while the device 100 is described hereafter as having radio functionality, the device 100 may be generally configured to provide microphone/speaker functionality to another device, and may not include a radio.

As depicted, the device 100 comprises: the MEMS microphones 101, 111, the speakers 103, 113, a motion detector 201, a communication unit 202, a processing unit 203, a Random-Access Memory (RAM) 204, one or more wireless transceivers 208 (which may be optional), one or more wired and/or wireless input/output (I/O) interfaces 209, a combined modulator/demodulator 210, a code Read Only Memory (ROM) 212, a common data and address bus 217, a controller 220, and a static memory 222 storing: at least one application 223 and one or more predetermined drop parameters 224. Hereafter, the at least one application 223 will be interchangeably referred to as the application 223.

The MEMS microphones 101, 111 comprise respective membranes 231, 241 such as respective dynamic membrane. While not depicted, the MEMs microphones 101, 111 may further comprise a respective second membranes, such as respective static membrane. However dynamic membranes are more prone to damage due to a drop than static membranes.

The speakers 103, 113 may comprise any suitable speaker; in particular the speaker 103 may comprise an earpiece speaker, and the speaker 113 may comprise a loudspeaker that may be used to operate the device 100 in a handsfree communication mode, and the like. In general, the speaker 113 may be configured to emit louder sounds than the speaker 103.

While the device 100 includes two MEMS microphones 101, 111 and two speakers 103, 113, the device 100 may include as few as one MEMS microphone and one speaker.

The motion detector 201 may include one or more motion and/or movement sensors (such as an accelerometer, magnetometer, and/or gyroscope) that may periodically or intermittently provide to the controller 220 data indicative of orientation, direction, steps, acceleration, and/or speed. In particular, the motion detector 201 may provide data to the controller 220 indicative of the device 100 being dropped. In particular examples, the motion detector 201 comprises an accelerometer, however the motion detector 201 may comprise any suitable device and/or combination of devices, which detects motion and, in particular, may provide data to the controller 220 indicative of the device 100 being dropped, as well as data indicative of the device 100 not being dropped and/or an end of a drop (e.g. due to an impact with a surface).

As shown in FIG. 2, the device 100 includes the communication unit 202 communicatively coupled to the common data and address bus 217 of the processing unit 203.

The processing unit 203 may include the code Read Only Memory (ROM) 212 coupled to the common data and address bus 217 for storing data for initializing system components. The processing unit 203 may further include the controller 220 coupled, by the common data and address bus 217, to the Random-Access Memory 204 and the static memory 222.

The communication unit 202 may include one or more wired and/or wireless input/output (I/O) interfaces 209 that are configurable to communicate with one or more wired and/or wireless communication networks, and the like. For example, the communication unit 202 may include one or more transceivers 208 and/or wireless transceivers for communicating with one or more communication networks, and the like. For example, the one or more transceivers 208 may be adapted for communication with one or more of the Internet, a digital mobile radio (DMR) network, a Project 25 (P25) network, a terrestrial trunked radio (TETRA) network, a Bluetooth network, a Wi-Fi network, for example operating in accordance with an IEEE 802.11 standard (e.g., 802.11a, 802.11b, 802.11g), an LTE (Long-Term Evolution) network and/or other types of GSM (Global System for Mobile communications) networks, a 5G network, a Worldwide Interoperability for Microwave Access (WiMAX) network, for example operating in accordance with an IEEE 802.16 standard, and/or another similar type of wireless network. Hence, the one or more transceivers 208 may include, but are not limited to, a cell phone transceiver, a DMR transceiver, P25 transceiver, a TETRA transceiver, a Bluetooth transceiver, a Wi-Fi transceiver, a WiMAX transceiver, and/or another similar type of wireless transceiver configurable to communicate via a wireless radio network.

The communication unit 202 may include one or more wireline transceivers 208, and the like, such as an Ethernet transceiver, a USB (Universal Serial Bus) transceiver, or similar transceiver configurable to communicate via a twisted pair wire, a coaxial cable, a fiber-optic link, or a similar physical connection to a wireline network. The transceiver 208 is also coupled to a combined modulator/demodulator 210.

The controller 220 may include ports (e.g. hardware ports) for coupling to other hardware components of the device 100, such as the MEMS microphones 101, 111, the speakers 103, 113 and the motion detector 201.

The controller 220 includes one or more logic circuits, one or more processors, one or more microprocessors, one or more ASIC (application-specific integrated circuits) and one or more FPGA (field-programmable gate arrays), and/or another electronic device. In some examples, the controller 220 and/or the device 100 is not a generic controller and/or a generic device, but a device specifically configured to implement functionality for controlling a speaker to emit a sound to protect a microphone. For example, in some examples, the device 100 and/or the controller 220 specifically comprises a computer executable engine configured to implement functionality for controlling a speaker to emit a sound to protect a microphone.

The static memory 222 is a non-transitory machine readable medium that stores machine readable instructions to implement one or more programs or applications. Example machine readable media include a non-volatile storage unit (e.g. Erasable Electronic Programmable Read Only Memory ("EEPROM"), Flash Memory) and/or a volatile storage unit (e.g. random-access memory ("RAM")). In the example of FIG. 2, programming instructions (e.g., machine readable instructions) that implement the functional teachings of the device 100 as described herein are maintained, persistently, at the memory 222 and used by the controller 220 which makes appropriate utilization of volatile storage during the execution of such programming instructions.

Figure 3:
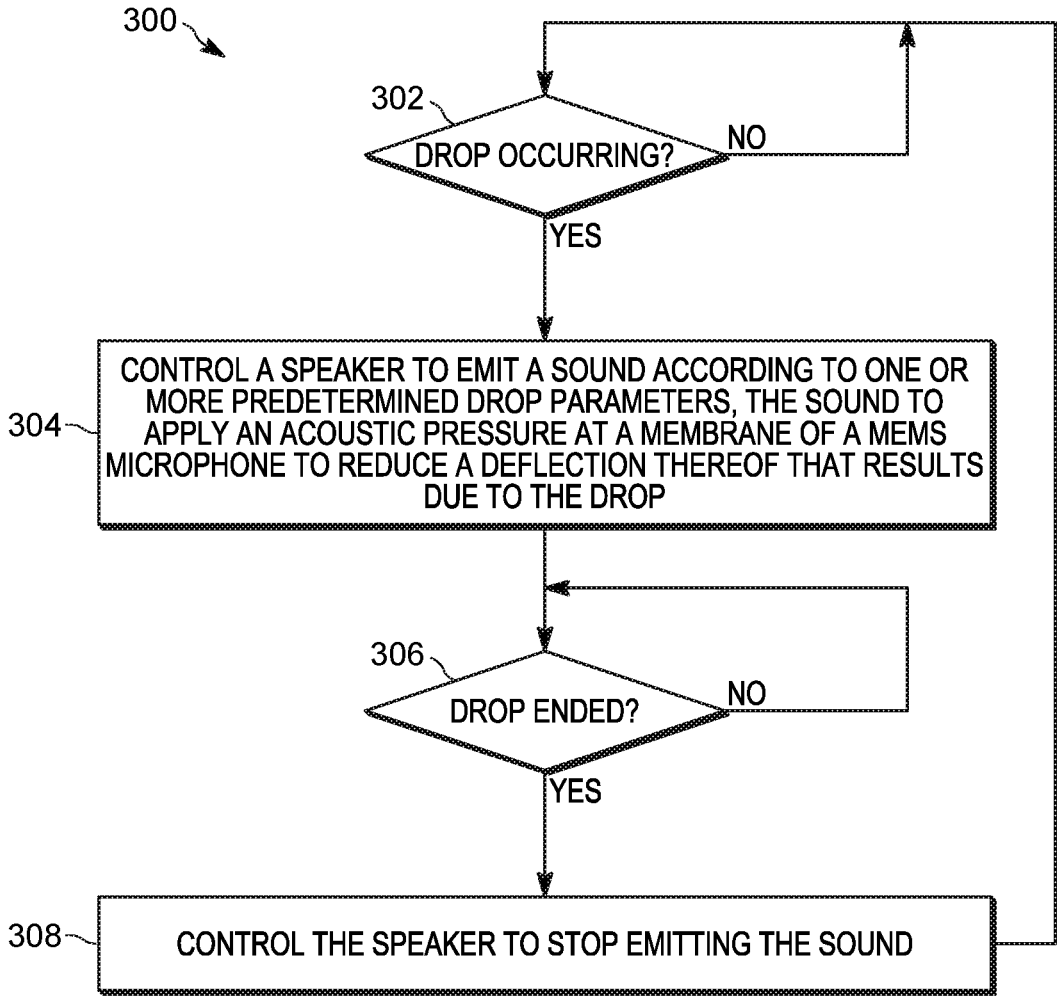
FIG. 3 is a flowchart of a method for controlling a speaker to emit a sound to protect a microphone, in accordance with some examples.

In particular, the memory 222 stores instructions corresponding to the at least one application 223 that, when executed by the controller 220, enables the controller 220 to implement functionality for controlling a speaker to emit a sound to protect a microphone including, but not limited to, the blocks of the method set forth in FIG. 3. In illustrated examples, when the controller 220 executes the one or more applications 223, the controller 220 is enabled to: determine, using the motion detector 201, when a drop is occurring; and in response to determining that a drop is occurring, control the speaker 103 (and/or alternatively the speaker 113) to emit a sound according to the one or more predetermined drop parameters 224, the sound to apply an acoustic pressure at the membrane 231 (and/or the membrane 241) of the MEMS microphone 101 (and/or the MEMS microphone 111) to reduce a deflection thereof that results due to the drop and/or an impact which ends the drop.

The one or more predetermined drop parameters 224 generally comprise parameters for controlling the speaker 103 and/or the speaker 113 to emit a sound that cause a particular acoustic pressure at the membrane 231 and/or the membrane 241. For example, the one or more predetermined drop parameters 224 may comprise a combination of a voltage and a current to drive the speaker 103 and/or the speaker 113 to cause a particular acoustic pressure at the membrane 231 and/or the membrane 241. The one or more predetermined drop parameters 224 for the speaker 103 may be the same as, or different from, the one or more predetermined drop parameters 224 for the speaker 113. The one or more predetermined drop parameters 224 may be determined by controlling each of the speakers 103, 113 to emit a sound (e.g. while the other speaker 103, 113 is silent, or simultaneously) and measuring the acoustic pressure at the membrane 231 and/or the membrane 241; when an acoustic pressure is achieved that has been determined to reduce damage at the membrane 231 and/or the membrane 241 due to a drop, the parameters to which the speaker 103 and/or the speaker 113 are controlled to achieve the acoustic pressure are determined and stored at the memory 224 as the one or more predetermined drop parameters 224.

In some examples, the one or more predetermined drop parameters 224 may be to control both of the speakers 103, 113 to emit a respective sound (e.g. simultaneously) when a drop is occurring, such that the respective sounds emitted by both the speakers 103, 113 is used to achieve the acoustic pressure.

While any suitable predetermined drop parameters 224 are within the scope of the present specification, as is any suitable acoustic pressure, in some examples, the one or more predetermined drop parameters 224 may be selected to cause an acoustic pressure at the membrane 231 and/or the membrane 241 in a range of about 50 dba (A-weighted decibels) to about 200 dba. However, acoustic pressures inside and outside of this range are within the scope of the present specification and may be determined experimentally and/or heuristically for a given MEMS microphone; similarly, one or more predetermined drop parameters 224 may be determined experimentally and/or heuristically for a given speaker.

Regardless, one or more respective predetermined drop parameters 224 may be stored at the memory 222 for both speakers 103, 113, which may be operated either alone or simultaneously.

As the sounds emitted by the speaker 103 and/or the speaker 113 (e.g. to apply an acoustic pressure at the membrane 231 and/or the membrane 241 to reduce a deflection thereof that results due to a drop) may be loud and/or uncomfortable to a human when emitted in a human hearing frequency range, the one or more predetermined drop parameters 224 may control the speaker 103 and/or the speaker 113 may be to emit a sound at a frequency outside a human hearing frequency range. Put another way, the predetermined drop parameters 224 may be selected to control the speaker 103 and/or the speaker 113 to emit a sound at a frequency outside a human hearing frequency range.

Attention is now directed to FIG. 3 which depicts a flowchart representative of a method 300 for controlling a speaker to emit a sound to protect a microphone. The operations of the method 300 of FIG. 3 correspond to machine readable instructions that are executed by the device 100, and specifically the controller 220 of the device 100. In the illustrated example, the instructions represented by the blocks of FIG. 3 are stored at the memory 222 for example, as the application 223. The method 300 of FIG. 3 is one way in which the controller 220 and/or the device 100 may be configured. Furthermore, the following discussion of the method 300 of FIG. 3 will lead to a further understanding of the device 100, and its various components.

The method 300 of FIG. 3 need not be performed in the exact sequence as shown and likewise various blocks may be performed in parallel rather than in sequence. Accordingly, the elements of method 300 are referred to herein as "blocks" rather than "steps."

At a block 302, the controller 220 and/or the device 100 determines, using the motion detector 201, whether a drop is occurring. For example, as described above, the motion detector 201 generally provides data to the controller 220 which may be indicative of the device 100 being dropped. In some examples, the motion detector 201 may be configured to determine that a drop is occurring based on measurements by a movement sensor at the motion detector 201, and provide an indication of a drop to the controller 220. Alternatively, the motion detector 201 may provide movement sensor data to the controller 220, for example, periodically and/or in a data stream and the controller 220 may be configured to determine, from the movement sensor data, that a drop is occurring. For example, a first set (and/or sets) of acceleration and/or speed and/or direction measurements may be indicative of a drop occurring. Similarly, a second set (and/or sets) of acceleration and/or speed and/or direction measurements may be indicative of a drop not occurring, and/or a drop ending.

In response to determining that a drop is not occurring (e.g. a "NO" decision at the block 302), the controller 220 and/or the device 100 repeats the block 302, for example until a drop is detected.

For example, in response to determining that a drop is occurring (e.g. a "YES" decision at the block 302), at a block 304, the controller 220 and/or the device 100, controls the speaker 103 (and/or alternatively the speaker 113) to emit a sound (and/or a respective sound) according to the one or more predetermined drop parameters 224, the sound to apply an acoustic pressure at the membrane 231 (and/or the membrane 241) of the MEMS microphone 101 (and/or the MEMS microphone 111) to reduce a deflection thereof that results due to the drop and/or an impact which ends the drop.

In some examples, the controller 220 and/or the device 100 may increase a volume of the sound emitted by the speaker 103 and/or the speaker 113 as a function of time during the drop, such that the longer the fall, the louder the sound emitted by the speaker 103 and/or the speaker 113, with the one or more predetermined parameters 224 selected accordingly. For examples, longer drops may result in harder impacts at a surface, and hence louder sounds may be used for longer falls which may better prevent damage of the membrane 231 and/or the membrane 241.

At an optional block 306, the controller 220 and/or the device 100 determines whether the drop has ended using, for example, using one or more of the motion detector 201 and the MEMS microphone 101 and/or the MEMS microphone 111.

In some examples, the controller 220 and/or the device 100 may determine that a drop has ended based on data from the motion sensor 201 indicating that the device 100 is no longer dropping and/or no longer moving.

In other examples, the controller 220 and/or the device 100 may determine that a drop has ended using the MEMS microphone 101 and/or the MEMS microphone 111. For example, the MEMS microphone 101 and/or the MEMS microphone 111 may detect a displacement of the membrane 231 and/or the membrane 241 due an impact of the device 100 at a surface which ends the drop. Such a displacement may have particular characteristics which may be used to determine that the displacement corresponds to an impact which ends a drop; for example, such a displacement may occur over a given time period, and/or have particular shape as a function of time (e.g. see FIG. 5). In some examples, such a displacement may be measured by way of sound detected at the MEMS microphone 101 and/or the MEMS microphone 111.

In response to determining that a drop has not ended (e.g. a "NO" decision at the block 306), the controller 220 and/or the device 100 repeats the block 306, for example until the controller 220 and/or the device 100 determines that the drop has ended. In such examples, the speaker 103 and/or the speaker 113 continues to emit a sound as controlled at the block 304 as the device 100 may still be dropping.

In response to determining that a drop has ended (e.g. a "YES" decision at the block 306), at a block 308, the controller 220 and/or the device 100 controls the speaker 103 and/or the speaker 113 to stop emitting the sound. The method 300 may repeat after the block 308.

Put another way, when one or both of the speakers 103, 113 is controlled to emit a respective sound at the block 304, at the block 308, the controller 220 and/or the device 100 controls the same one or both of the speakers 103, 113 to stop emitting the respective sound. A drop may end when the device 100 impacts a surface.

Put yet another way, the controller 220 and/or the device 100 may be further configured to: determine, using one or more of the motion detector 201 and the MEMS microphone 101 (and/or the MEMS microphone 111), that the drop has ended; and in response to determining that the drop has ended, control the speaker 103 (and/or the speaker 113) to stop emitting a sound (and/or a respective sound).

In some examples, in response to determining that a drop has ended, the controller 220 and/or the device 100 controls the speaker 103 and/or the speaker 113 to stop emitting the sound after a given time period after the drop has ended, for example 5 seconds and the like, to allow for the device 100 bouncing, and the like, due to the device 100 impacting a surface, and which may cause further increased displacement of the membrane 231 and/or the membrane 241. For example, the effects of an initial impact may occur over a time period of about 1 second (e.g. see FIG. 5), and bounces may occur over another few seconds.

Put another way, the controller 220 and/or the device 100 may be further configured to: determine, using one or more of the motion detector 201 and the MEMS microphone 101 (and/or the MEMS microphone 111), that the drop has ended; and in response to determining that the drop has ended, control the speaker 103 (and/or the speaker 113) to stop emitting a sound (and/or a respective sound) after a given time period after the drop has ended. Such a given time period may be preconfigured at the memory 222 and/or the given time period may be determined based on factors such as a length of time of a drop (e.g. with relatively longer drops resulting in longer given time periods, and relatively shorter drops resulting in shorter given time periods).

In yet further examples, the block 306 may be optional and the controller 220 and/or the device 100 may be further configured to: control the speaker 103 (and/or the speaker 113) to emit a sound (e.g. as controlled at the block 304) for a given time period. Put another way, at the block 308, the controller 220 and/or the device 100 may control the speaker 103 (and/or the speaker 113) to stop emitting the sound (e.g. as controlled at the block 304) after the given time period. For example, it may be experimentally and/or heuristically determined that, when a device is dropped, such a drop generally occurs, on average, for less than 10 seconds; hence, at the block 308, the controller 220 and/or the device 100 may control the speaker 103 (and/or the speaker 113) to stop emitting the sound (e.g. as controlled at the block 304) after 10 seconds. Such an example obviates the device 100 detecting when a drop has ended and may be more efficient than implementing the block 306.

The method 300 has been described with respect to one or both of the speakers 103, 113 being controlled to emit a sound at the block 304. Put another way, at the block 304, the controller 220 and/or the device 100 may, in response to determining that the drop is occurring: control the speaker 103 to emit a sound according to one or more predetermined drop parameters 224, the sound to apply an acoustic pressure at the 231 membrane of the MEMS microphone 101 to reduce a deflection thereof that results due to the drop; and (e.g. when the device 100 comprises at least a second MEMS microphone 111 and a second speaker 113) control a second speaker 103 to emit a respective sound according to one or more respective predetermined drop parameters 224, the respective sound to apply a respective acoustic pressure at a respective membrane of the second MEMS microphone 111 to reduce a respective deflection thereof that results due to the drop.

However, the device 100 may comprise one MEMS microphone (e.g. the MEMS microphone 101) and one speaker (e.g. the speaker 103) and the method 300 may hence be implemented with, for example, the MEMS microphone 101 and the speaker 103.

Furthermore, as shown in FIG. 1, a MEMS microphone and a speaker of the device 100 may be one or more of: adjacent to each other; and separated from each other. For example, the method 300 may be implemented with a MEMS microphone and a speaker that are adjacent to each other, such as the MEMS microphone 101 and the speaker 103 of an earpiece, and/or the MEMS microphone 111 and the speaker 113.

However, when a MEMS microphone and a speaker are separated from each other, such as the MEMS microphone 101 and the speaker 113, the method 300 may be implemented using a loudspeaker. In particular, a loudspeaker (e.g. the speaker 113) may be configured to emit louder sounds than an earpiece speaker (e.g. the speaker 103); hence to achieve an acoustic pressure at a membrane of a MEMS microphone using a speaker that is separated from the MEMS microphone, it may be preferable that the speaker comprise a loudspeaker.

Figure 4:
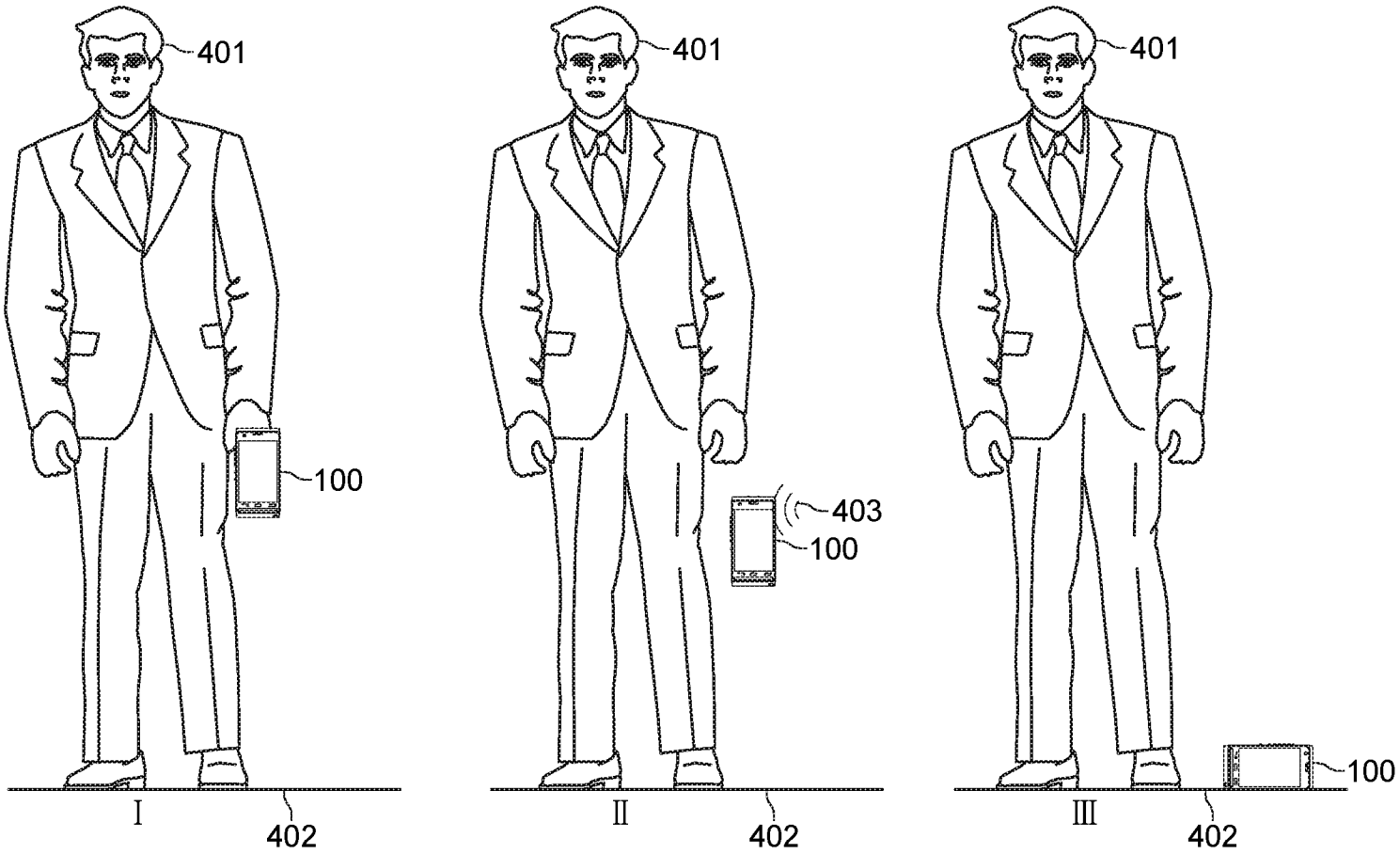
FIG. 4 depicts the device of FIG. 1 implementing a method for controlling a speaker to emit a sound to protect a microphone, in accordance with some examples.

Attention is next directed to FIG. 4 which depicts a sequence of views I, II, III, showing an example of the method 300.

At the view I, the device 100 is being held by a user 401 standing on a surface 402.

At the view II, which follows the view I in time, the user 401 has dropped the device 100, and the device 100 has detected (e.g. at the block 302 of the method 300) the drop (e.g. using the motion sensor 201), and controlled (e.g. at the block 304 of the method 300) a speaker (e.g. the speaker 103 and/or the speaker 113) to emit a sound 403 (and/or respective sounds). The sound 403 applies an acoustic pressure at least at the membrane 231 of the MEMS microphone 101 to reduce a deflection thereof that results due to the drop/or an impact which ends the drop.

At the view III, which follows the view II in time, the device 100 has impacted the surface 402 and the device 100 has detected (e.g. at the block 306 of the method 300) that the drop has ended, and controlled (e.g. at the block 308 of the method 300) the speaker (e.g. the speaker 103 and/or the speaker 113) that was emitting the sound 403 (and/or respective sounds) to stop emitting the sound 403 (and/or respective sounds).

Figure 5:
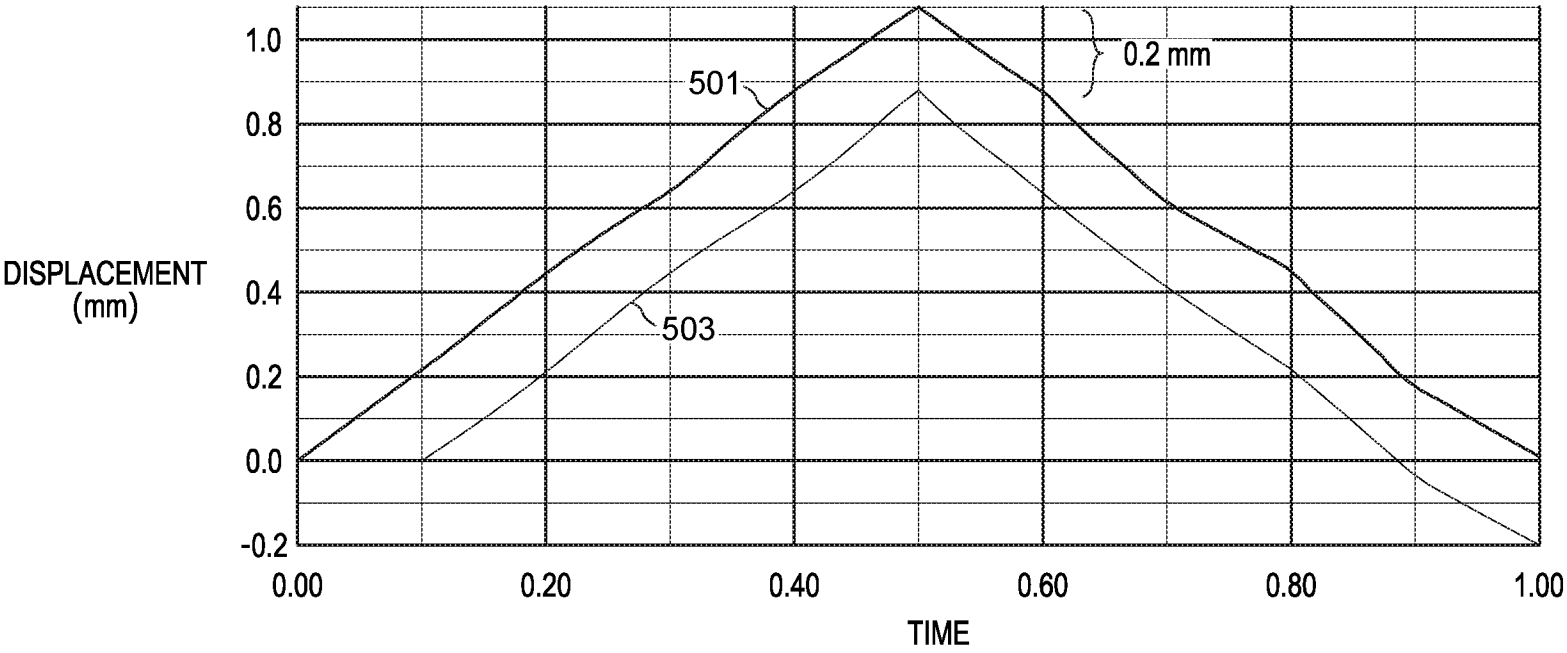
FIG. 5 depicts example curves of displacement of an example membrane of a MEMS device microphone as a function of time due to a drop and subsequent impacting of a surface, in accordance with some examples.

Attention is next directed to FIG. 5 which depicts example curves 501, 503 of displacement of the membrane 231 of the MEMS microphone 101 as a function of time due to a drop and subsequent impacting a surface, as described above. The curve 501 shows displacement of the membrane 231, as a function of time, in the absence of a sound emitted by the speaker 103. The curve 503 shows displacement of the membrane 231, as a function of time, with a sound of about 125 dba (A-weighted decibels) emitted by the speaker 103. Comparing, the peaks of the curves 501, 503, a displacement of the membrane 231 is reduced by about 0.2 mm in the presence of sound of about 125 dba emitted by the speaker 103, as compared to when no sound is emitted by the speaker 103, which may reduce damage of the membrane 231. The curves 501, 503 also show examples of a particular shape of shape of the displacement as a function of time which may be used to detect when an impact has occurred and/or when a drop has ended. The curves 501, 503 also show that effects of an impact may occur over a time period of about 1 second.

In the foregoing specification, specific embodiments have been described. However, one of ordinary skill in the art appreciates that various modifications and changes may be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

In this document, language of "at least one of X, Y, and Z" and "one or more of X, Y and Z" may be construed as X only, Y only, Z only, or any combination of two or more items X, Y, and Z (e.g., XYZ, XY, YZ, XZ, and the like). Similar logic may be applied for two or more items in any occurrence of "at least one . . . " and "one or more . . . " language.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment may be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it may be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A device comprising:

a microelectrical-mechanical system (MEMS) microphone;

a speaker;

a motion detector; and a controller in communication with the motion detector and the speaker, the controller configured to:

determine, using the motion detector, when a drop is occurring; and in response to determining that a drop is occurring, control the speaker to emit a sound according to one or more predetermined drop parameters, the sound to apply an acoustic pressure at a membrane of the MEMS microphone to reduce a deflection thereof that results due to the device impacting a surface at an end of the drop, wherein the one or more predetermined drop parameters are selected to cause the acoustic pressure at the membrane to be a range of about 50 dba (A-weighted decibels) to about 200 dba, and wherein the one or more predetermined drop parameters are selected are further selected to control the speaker to emit the sound at a frequency outside a human hearing frequency range.

2. The device of claim 1, wherein the controller is further configured to:

control the speaker to emit the sound for a given time period.

3. The device of claim 1, wherein the controller is further configured to:

determine, using one or more of the motion detector and the MEMS microphone, that the drop has ended; and in response to determining that the drop has ended, control the speaker to stop emitting the sound.

4. The device of claim 1, wherein the controller is further configured to:

determine, using one or more of the motion detector and the MEMS microphone, that the drop has ended; and in response to determining that the drop has ended, control the speaker to stop emitting the sound after a given time period after the drop has ended.

5. The device of claim 1, wherein the MEMS microphone and the speaker are one or more of:

adjacent to each other; and separated from each other, and when the MEMS microphone and the speaker are separated from each other, the speaker comprises a loudspeaker.

6. The device of claim 1, wherein the MEMS microphone and the speaker are integrated into an earpiece.

7. The device of claim 1, further comprising a memory storing the predetermined drop parameters.

8. The device of claim 1, wherein the motion detector comprises an accelerometer.

9. The device of claim 1, further comprising at least a second MEMS microphone and a second speaker, and the controller is further configured to:

in response to determining that the drop is occurring, control the second speaker to emit a respective sound according to one or more respective predetermined drop parameters, the respective sound to apply a respective acoustic pressure at a respective membrane of the second MEMS microphone to reduce a respective deflection thereof that results due to the drop.

10. A method comprising:

determining, using a motion detector, when a drop is occurring at a device; and in response to determining that a drop is occurring, controlling a speaker of the device to emit a sound according to one or more predetermined drop parameters, the sound to apply an acoustic pressure at a membrane of a microelectrical-mechanical system (MEMS) of the device, to reduce a deflection thereof that results due to the device impacting a surface at an end of the drop, wherein the one or more redetermined drop parameters are selected to cause the acoustic pressure at the membrane to be a range of about 50 dba (A-weighted decibels) to about 200 dba, and wherein the one or more predetermined drop parameters are selected are further selected to control the speaker to emit the sound at a frequency outside a human hearing frequency range.

11. The method of claim 10, further comprising:

controlling the speaker to emit the sound for a given time period.

12. The method of claim 10, further comprising:

determining, using one or more of the motion detector and the MEMS microphone, that the drop has ended; and in response to determining that the drop has ended, controlling the speaker to stop emitting the sound.

13. The method of claim 10, further comprising:

determining, using one or more of the motion detector and the MEMS microphone, that the drop has ended; and in response to determining that the drop has ended, controlling the speaker to stop emitting the sound after a given time period after the drop has ended.

14. The method of claim 10, wherein the MEMS microphone and the speaker are one or more of:

adjacent to each other; and separated from each other, and when the MEMS microphone and the speaker are separated from each other, the speaker comprises a loudspeaker.

15. The method of claim 10, wherein the MEMS microphone and the speaker are integrated into an earpiece of the device.

16. The method of claim 10, wherein the motion detector comprises an accelerometer.

17. The method of claim 10, further comprising:

in response to determining that the drop is occurring, controlling a second speaker of the device to emit a respective sound according to one or more respective predetermined drop parameters, the respective sound to apply a respective acoustic pressure at a respective membrane of a second MEMS microphone of the device to reduce a respective deflection thereof that results due to the drop.

18. The method of claim 10, further comprising:

in response to determining that the drop is occurring, controlling the speaker to increase a volume of the sound as a function of time.

* * * * *